US010227967B2

(12) United States Patent
Beenker

(10) Patent No.: US 10,227,967 B2
(45) Date of Patent: Mar. 12, 2019

(54) CONVEYING DEVICE

(71) Applicant: Qonqave GmbH, Wernau (DE)

(72) Inventor: Jan W. Beenker, Stuttgart (DE)

(73) Assignee: Qonqave GmbH, Wernau (DE)

( * ) Notice: Subject to any disclaimer, the term of this patent is extended or adjusted under 35 U.S.C. 154(b) by 0 days.

(21) Appl. No.: 15/536,896

(22) PCT Filed: Dec. 17, 2015

(86) PCT No.: PCT/EP2015/080297
§ 371 (c)(1),
(2) Date: Jun. 16, 2017

(87) PCT Pub. No.: WO2016/097185
PCT Pub. Date: Jun. 23, 2016

(65) Prior Publication Data

US 2017/0350383 A1 Dec. 7, 2017

(30) Foreign Application Priority Data

Dec. 17, 2014 (DE) ..... 10 2014 118 926

(51) Int. Cl.
*F04B 43/12* (2006.01)
*F04B 43/02* (2006.01)
*F04B 43/04* (2006.01)

(52) U.S. Cl.
CPC ..... *F04B 43/1238* (2013.01); *F04B 43/02* (2013.01); *F04B 43/026* (2013.01); *F04B 43/04* (2013.01); *F04B 43/12* (2013.01)

(58) Field of Classification Search
CPC ... F04B 43/1238; F04B 43/025; F04B 43/026
USPC ..... 417/475
See application file for complete search history.

(56) References Cited

U.S. PATENT DOCUMENTS 2,097,028 A * 10/1937 Gates ..... B05B 7/0408 222/135
2,752,860 A * 7/1956 Waldin ..... F04B 43/026 416/81
2,894,459 A * 7/1959 McDuffie ..... F02M 59/14 417/273

(Continued)

FOREIGN PATENT DOCUMENTS

CA 2422579 C 11/2008
DE 102007034125 A1 1/2009

(Continued)

OTHER PUBLICATIONS

Search Report dated Oct. 15, 2015 issued in corresponding DE patent application No. 10 2014 118 926.4 (and partial English translation).

(Continued)

*Primary Examiner* — Charles G Freay
(74) *Attorney, Agent, or Firm* — Posz Law Group, PLC

(57) ABSTRACT

A conveying device at least for conveying a conveying medium, includes at least one first conveying space, with at least one second conveying space, with at least one elastically deformable conveying element which delimits at least the first conveying space, and with at least one third conveying space. The at least the conveying element is embodied in spring-elastic fashion.

9 Claims, 4 Drawing Sheets

(56) References Cited

U.S. PATENT DOCUMENTS

Figure 1:
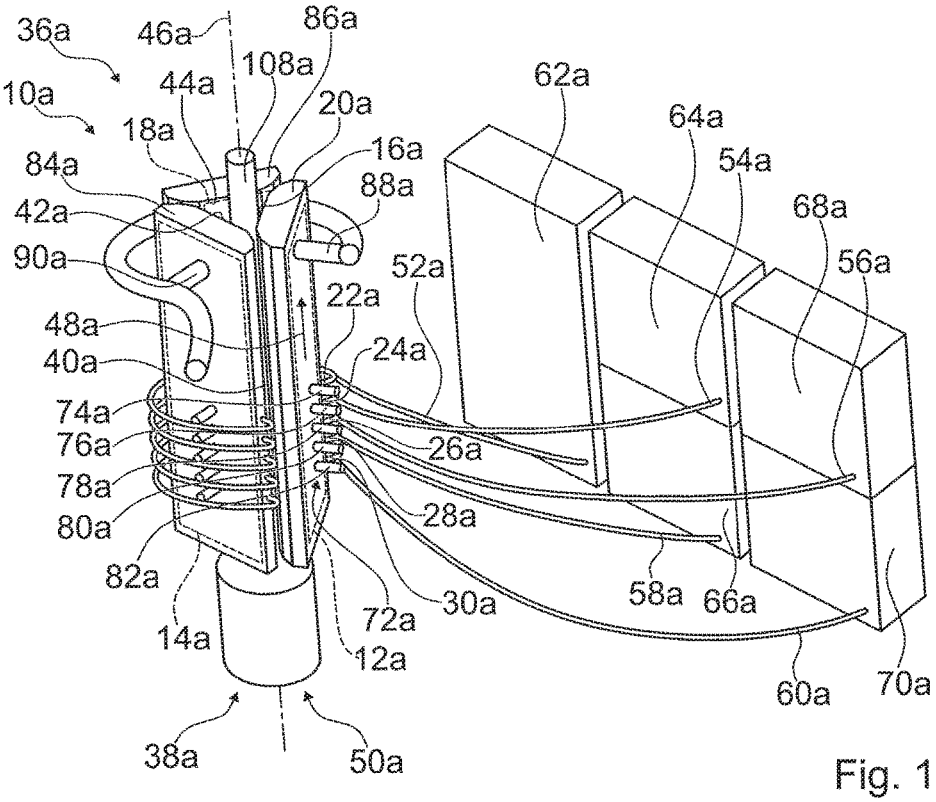

| | | | | | |
|---|---|---|---|---|---|
| 2,970,748 | A | * | 2/1961 | Bendall | F04B 45/10 417/475 |
| 3,046,903 | A | * | 7/1962 | Jones | A61M 1/1046 128/DIG. 3 |
| 3,229,643 | A | | 1/1966 | Roudaut | |
| 3,881,846 | A | * | 5/1975 | Kashmerick | F04B 43/0045 417/478 |
| 3,951,576 | A | * | 4/1976 | Lofquist, Jr. | F04C 2/1076 366/318 |
| 4,576,242 | A | * | 3/1986 | Mundell | F03C 7/00 175/107 |
| 5,033,943 | A | * | 7/1991 | Durrum | F04B 43/08 417/475 |
| 5,620,313 | A | * | 4/1997 | Fockenberg | F04B 43/12 417/475 |
| 6,041,709 | A | * | 3/2000 | Wells | B41F 31/08 101/350.6 |

FOREIGN PATENT DOCUMENTS

| | | | |
|---|---|---|---|
| EP | 1317626 | B1 | 8/2006 |
| JP | 2004-509270 | A | 3/2004 |
| WO | 2007/051454 | A2 | 5/2007 |

OTHER PUBLICATIONS

International Search Report of the International Searching Authority dated Mar. 29, 2016 issued in corresponding International Patent Application No. PCT/EP2015/080297.

International Preliminary Report on Patentability dated Jun. 22, 2017 issued in corresponding International Patent Application No. PCT/EP2015/080297 (and German version of Dec. 2, 2016 with Article 34 amendments).

Office action dated Nov. 28, 2018 issued in corresponding JP patent application No. 2017-539666 (and English summary attached).

* cited by examiner

CONVEYING DEVICE

CROSS REFERENCE TO RELATED APPLICATIONS

This application is a U.S. national stage application of PCT/EP2015/080297 filed on Dec. 17, 2015, which claims priority to German Patent Application No. DE 10 2014 118 926.4 filed on Dec. 17, 2014, the contents of which are incorporated herein by reference.

PRIOR ART

The invention relates to a conveying device as per the preamble of claim 1.

EP 1 317 626 B1 has already disclosed conveying devices at least for conveying a conveying medium, which conveying devices comprise a first conveying space, a second conveying space and an elastically deformable conveying element which delimits the first conveying space.

Furthermore, U.S. Pat. No. 3,229,643 A and WO 2007/051454 A2 have already disclosed conveying devices at least for conveying a conveying medium, which conveying devices comprise a first conveying space, a second conveying space and an elastically deformable conveying element which delimits the first conveying space. The conveying devices furthermore comprise at least one third conveying space.

Furthermore, from DE 10 2007 034 125 A1 a conveying device at least for a conveyance of a conveying medium is already known, with at least one first conveying space, with at least one second conveying space, with at least one elastically deformable conveying element, which delimits at least the first conveying space, with at least one third conveying space, wherein at least the conveying element is embodied in spring-elastic fashion, wherein the first conveying space, the second conveying space and the third conveying space are embodied respectively spaced apart from each other, wherein, following a deformation, the conveying element automatically seeks to re-assume a convexly curved basic shape of the conveying element, and with at least one rigid conveying space element, which delimits at least the first conveying space, the second conveying space and/or the third conveying space together with the conveying element, wherein the conveying element is in a non-conveyance state arranged on the conveying space element in a convexly curved fashion.

It is the object of the invention in particular to provide a generic device which has improved characteristics with regard to high variability in terms of a field of use and/or in terms of conveying performance for the purpose of allowing a conveyance of different fluids with a low load on the respective conveying spaces and/or on the conveying element. The object is achieved according to the invention by means of the features of patent claim 1, whereas advantageous embodiments and refinements of the invention emerge from the subclaims.

Advantages of the Invention

The invention is based on a conveying device at least for conveying a conveying medium, with at least one first conveying space, with at least one second conveying space, and with at least one elastically deformable conveying element which delimits at least the first conveying space, with at least one third conveying space, wherein at least the first conveying space, the second conveying space and the third conveying space are embodied respectively spaced apart from each other, wherein, following a deformation, the conveying element automatically seeks to re-assume a convexly curved basic shape of the conveying element, and with at least one rigid conveying space element, which delimits at least the first conveying space, the second conveying space and/or the third conveying space together with the conveying element, wherein the conveying element is in a non-conveyance state arranged on the conveying space element in a convexly curved fashion.

It is proposed that the conveying space element comprises, for at least partly forming the first conveying space, the second conveying space and/or the third conveying space, comprises at least one concave recess, wherein an inner surface of the conveying space element, which delimits the concave element, forms a wall of the first conveying space, the second conveying space and/or the third conveying space, wherein, for a conveyance of a conveying medium, the conveying element is, starting from a convex curvature, which is oriented in a direction facing away from the conveying space element, towards the conveying space element, elastically deformable and at least partly movable into the concave recess of the conveying space element. The conveying device is preferably provided for use in the medical sector. It is however also conceivable for the conveying device to be provided for use in other sectors, for example in a foodstuffs sector, in a chemistry sector, in a pharmaceutical sector, in particular for batch-compliant use, in a vivarium sector (aquarium etc.), in a household appliance sector, in a dental hygiene sector or the like. The expression "provided" is to be understood in particular to mean specially designed and/or specially equipped. The statement that an element and/or a unit are/is provided for a particular function is to be understood in particular to mean that the element and/or the unit perform(s) and/or carry/carries out said particular function in at least one usage and/or operating state.

Here, the expression "embodied in a rigid fashion" is intended in particular to define an embodiment of an element in which the element is of at least substantially stiff, immovable and/or inelastic form. The conveying space element is thus preferably provided so as to remain at least substantially, in particular entirely, unchanged in terms of shape for a conveyance of a conveying medium.

The conveying element is preferably provided so as to be deformed, in particular elastically deformed, for a conveyance of a conveying medium, in particular a fluid. The conveying element is preferably provided so as to permit a conveyance of a conveying medium out of and/or through the first conveying space, the second conveying space and/or the third conveying space as a result of a deformation of the conveying element. It is advantageously possible to realize dynamic conveyance of a conveying medium or conveyance of a conveying medium with displacement action.

For conveyance of a conveying medium with displacement action, the conveying element can preferably be caused, as a result of a deformation, to at least partly bear directly against an inner surface, which delimits the recess, of the conveying device, in particular of the conveying space element of the conveying device. The conveying element is preferably in the form of a diaphragm pump element, in particular a flexurally rigid diaphragm pump element. The conveying element is preferably formed so as to differ from a peristaltic pump element, in particular an elastic hose of a peristaltic pump device.

Here, the expression "conveying space" defines in particular a space which is delimited at least by the elastically deformable conveying element and by the conveying space element embodied in a rigid fashion and which extends in particular between the conveying element and the conveying space element at least from an inlet of the space, through which a conveying medium for conveying can be introduced into the space, to at least one outlet of the space, through which a conveying medium for conveying can be discharged from the space. It is preferable for the conveying space to extend between the conveying element and the conveying space element at least from a conveying space inlet of the conveying space to a conveying space outlet of the conveying space.

The elastically deformable conveying element is preferably provided for sealing off at least one edge region, which delimits the first conveying space, of the conveying space element embodied in a rigid fashion, in particular in at least a state in which the conveying element is arranged on the conveying space element. The elastically deformable conveying element can preferably be arranged on the conveying space element embodied in a rigid fashion such that the at least one edge region, which delimits the conveying space, of the conveying space element can be sealed off. Sealing-off of the at least one edge region, which delimits the first conveying space, of the conveying space element may be realized directly by means of the conveying element. It is however alternatively or additionally also conceivable for a seal element of the conveying device to be provided which can be arranged between the conveying element and the conveying space element, in particular on the at least one edge region, which delimits the first conveying space, of the conveying space element. The seal element of the conveying device may be formed as a rubber seal, as a sealing cord, as a sealing lip, as a flexible seal compound, as a fiber seal, as a paper seal or the like.

The conveying device preferably comprises at least one conveying medium store unit for storing a conveying medium, in particular a fluid. Here, a "conveying medium store unit" is to be understood in particular to mean a unit which has at least one storage space in which a conveying medium, in particular a fluid, can be stored. A volume of the storage space of the conveying medium store unit is preferably at least greater than a volume of the first conveying space, a volume of the second conveying space and/or a volume of the third conveying space. The conveying medium store unit is preferably formed in the manner of a tank. Here, the conveying medium store unit may be in the form of a carpule, an ampule, a cartridge or the like. The conveying medium store unit is preferably connected in terms of flow to the first conveying space, to the second conveying space and/or to the third conveying space. It is preferable for an outlet of the conveying medium store unit to be connected, in particular connected in fluid-tight fashion, by means of a duct of the conveying device to the conveying space inlet of the first conveying space, of the second conveying space and/or of the third conveying space. A conveying medium stored in the storage space of the conveying medium store unit can thus advantageously be conveyed out of the storage space by means of an interaction of the conveying element and the conveying space element.

The expression "spring-elastic" is to be understood in particular to mean a characteristic of an element, in particular of the conveying element, which characteristic is provided in particular for generating an opposing force which is dependent on a change in a shape of the element and which is preferably proportional to the change and which counteracts the change. The conveying element is preferably repeatedly deformable without the conveying element thereby being mechanically damaged or destroyed. The spring-elastic form of the conveying element can preferably be at least partly influenced and/or realized by means of the convex arrangement on the conveying space element. The conveying element is preferably arranged on the conveying space element such that a conveying medium is conveyed in and/or through the conveying space as a result of an inward bulging of the conveying element. After an elimination of an action of a drive force on the conveying element for a conveyance of a conveying medium, the conveying element, preferably at least substantially automatically seeks to reassume the convexly curved arrangement on the conveying space element, in particular owing to the spring-elastic form. The conveying element is preferably produced from a spring steel or from a fiber composite material. It is however also conceivable for the conveying element to be produced from some other material which appears expedient to a person skilled in the art and which permits a spring-elastic form of the conveying element. The conveying element preferably utilizes a "bulging effect" for a conveyance of a conveying medium in and/or through the conveying space. The conveying element can preferably be at least temporarily inwardly bulged for a conveyance of a conveying medium, wherein at least one bulge is displaceable along a longitudinal axis of the conveying element for the purposes of conveying a conveying medium. The conveying element is preferably of dimensionally stable form. Here, "dimensionally stable" is to be understood to mean that the conveying element is preferably formed so as to be resilient in terms of shape with respect to pressure, heat or the like.

By means of the embodiment according to the invention, it is advantageously possible to realize high variability in terms of a field of use and/or in terms of conveying performance of the conveying device. Furthermore, it is advantageously possible for different conveying media to be conveyed by means of the conveying device from different containers, which are in particular not connected to one another in terms of flow. The conveying device can thus advantageously be utilized for mixing and/or dosing different conveying media. It is thus advantageously possible for a large usage spectrum to be covered, for which the conveying device according to the invention is suitable. It is furthermore advantageously possible, in a manner dependent on control of the individual conveying spaces, to realize a low load on a single conveying space during conveyance of a single conveying medium through the individual conveying spaces in the case of alternating conveyance by means of the individual conveying spaces. It is thus advantageously possible to achieve a long service life of the conveying device. Furthermore, by means of the embodiment according to the invention, it is advantageously possible to permit efficient conveyance of a conveying medium, in particular with a small number of components. It is furthermore advantageously possible for an internal stress, in particular an internal mechanical stress, of the conveying element to be utilized for a conveyance of a conveying medium.

It is furthermore proposed that the first conveying space has a maximum volume which differs from a maximum volume of the second conveying space and/or differs from a maximum volume of the third conveying space. The first conveying space preferably has a maximum volume which differs from a maximum volume of the second conveying space, and/or differs from a maximum volume of the third conveying space, in particular by a magnitude of at least +/−1%, preferably by a magnitude of at least +/−5% and particularly preferably by a magnitude of at least +/−10%, in particular in relation to the maximum volume. By means of the embodiment according to the invention, it is advantageously possible to permit a high level of variability with regard to a conveying rate and/or with regard to conveying performance.

In at least one design variant of the conveying device according to the invention, the conveying space element embodied in a rigid fashion preferably delimits, together with the conveying element, at least the first conveying space, the second conveying space and the third conveying space. It is however also conceivable for the conveying space element embodied in a rigid fashion to additionally delimit, together with the conveying element, further conveying spaces of the conveying device, for example four conveying spaces, five conveying spaces, six conveying spaces, seven conveying spaces, more than seven conveying spaces, more than twenty conveying spaces or the like. It would be conceivable for a single elastically deformable conveying element of the conveying device to delimit, together with the conveying space element embodied in a rigid fashion, a multiplicity of conveying spaces of the conveying device. In an alternative embodiment of the conveying device according to the invention, it is however also conceivable for in each case one conveying space to be delimited by a single elastically deformable conveying element and by a single conveying space element embodied in a rigid fashion. It is preferable, in particular in the alternative embodiment of the conveying device according to the invention, for at least the conveying space element embodied in a rigid fashion and the elastically deformable conveying element to together form an exchangeable unit. Here, an "exchangeable unit" is to be understood in particular to mean a unit which is removable as a whole, in particular without being destroyed or without disassembly of individual parts, from an element or from a further unit, such as for example from a housing unit or the like, in particular after a release of at least one fastening element which is provided for fastening the unit on the element or on the further unit. It is preferable, in particular in the alternative embodiment of the conveying device according to the invention, for the conveying device to be arranged on a pump device. In particular in the alternative embodiment of the conveying device according to the invention, the exchangeable unit is preferably removable as a whole from the element or from the further unit without being disassembled into individual parts. In particular in the alternative embodiment of the conveying device according to the invention, it is preferably the case that at least the conveying space element and the conveying element are jointly removable from the element or from the further unit, in particular from a housing unit of a pump device which comprises the conveying device. In particular in the alternative embodiment of the conveying device according to the invention, it is preferable if the exchangeable unit is, after being removed from the element or from the further unit, exchangeable for a replacement or substitute unit which, with regard to at least one function of the replacement or substitute unit, at least substantially corresponds to at least one function of the exchangeable unit. In particular in the alternative embodiment of the conveying device according to the invention, it is preferable for the exchangeable unit to be formed as a disposable article unit. By means of the embodiment of the conveying device according to the invention, it is advantageously possible for a multiplicity of conveying spaces to be realized with few components. It is thus advantageously possible to achieve a high level of variability of the conveying device.

It is furthermore proposed that the conveying element additionally delimits at least the second conveying space and/or the third conveying space. In at least one embodiment of the conveying device according to the invention, the conveying element additionally, in particular in addition to the first conveying space, delimits at least the second conveying space and the third conveying space, in particular together with the conveying space element embodied in a rigid fashion. It is however also conceivable for the conveying element to delimit further conveying spaces of the conveying device. By means of the embodiment according to the invention, it is advantageously possible for a multiplicity of conveying spaces to be formed with few components. It is thus advantageously possible to provide a conveying device by means of which a high conveying rate can be realized.

To delimit the first conveying space, the second conveying space and/or the third conveying space, the conveying element may be arranged on a side of the conveying space element facing toward a drive element of a drive unit of the pump device, or may be arranged on a side of the conveying space element averted from the drive element. Further refinements that appear expedient to a person skilled in the art are likewise conceivable. For a conveyance of a conveying medium, the conveying element can preferably be changed at least partly from a convex curvature into a concave curvature. The conveying element can preferably be caused to bear at least partly against the inner surface, which delimits the concave recess of the conveying space element and which is oriented in particular in the direction of the conveying element, of the conveying space element, in particular owing to a drive force acting on the conveying element. It is very particularly preferably possible for at least one conveying surface of the conveying element to be caused to bear entirely against the inner surface of the conveying space element, which inner surface delimits the concave recess of the conveying space element, as a result of an elastic deformation of the conveying element. By means of the embodiment according to the invention, it is particularly advantageously possible for a multiplicity of conveying spaces to be formed with few components. It is thus advantageously possible to provide a conveying device by means of which a high conveying rate can be realized and which has a plurality of conveying spaces, in particular different conveying spaces.

It is furthermore proposed that at least the first conveying space comprises at least two conveying space inlets. It is preferable for the second and/or the third conveying space to comprise at least two conveying space inlets. It is however also conceivable for the first conveying space, the second conveying space and/or the third conveying space to comprise a number of conveying space inlets that differs from two, for example only one conveying space inlet, three conveying space inlets, four conveying space inlets, five conveying space inlets or more than five conveying space inlets. The first conveying space preferably comprises only one conveying space outlet. The second conveying space preferably comprises only one conveying space outlet. The third conveying space preferably comprises only one conveying space outlet. It is preferable for all conveying spaces of the conveying device to comprise in each case one single conveying space outlet. It is however also conceivable for the first conveying space, the second conveying space, the third conveying space and/or further conveying spaces of the conveying device to have more than one conveying space outlet. The conveying space outlets of the first conveying space, of the second conveying space and of the third conveying space are preferably connected to one another in terms of flow. The conveying device preferably comprises at least one conveying space outlet line which is provided for connecting the conveying space outlets of the first conveying space, of the second conveying space and of the third conveying space to one another in terms of flow. The conveying space outlet line is preferably provided for connecting the conveying device in terms of flow to a further unit. Here, the further unit may be a part of the pump device, a part of an administration device, such as for example an ampule, a carpule or the like, a part of a household appliance, a part of a dental hygiene machine, such as for example an oral irrigator, or the like. It is however also conceivable for each individual conveying space outlet to be connectable in terms of flow in each case to a further unit, or to multiple further units, by means of a separate conveying space outlet line of the conveying device. By means of the embodiment according to the invention, it is advantageously possible to achieve that the conveying device can be used for mixing different conveying media, which can be conveyed in particular separately into the individual conveying spaces.

The conveying element is advantageously connected at least substantially non-detachably to the conveying space element. The conveying element may be connected along an entire circumference, in particular as viewed in at least one plane, in at least substantially non-detachable fashion to the conveying space element, or the conveying element may be connected by means of at least one single side in at least substantially non-detachable fashion to the conveying space element, for example by means of a film hinge or the like. The conveying element and the conveying space element are preferably formed in one piece, for example by means of an injection molding process or the like, in particular with an at least substantially non-detachable connection of the conveying element and of the conveying space element by means of a film hinge or the like. The conveying element and the conveying space element are preferably formed from an identical material, for example plastic or metal, or from an identical material composite, for example GRP, some other composite material or the like. It is however also conceivable for the conveying element and the conveying space element to be formed from different materials and to be connected to one another in at least substantially non-detachable fashion.

It is furthermore proposed that the conveying element comprises at least one conveying surface which, viewed in a cross-section of the conveying element, has a maximum transverse extent which is at least substantially equivalent to a maximum transverse extent of a rigid wall of the first conveying space, which wall delimits at least the first conveying space. The expression "at least substantially" is to be understood, in particular at least in conjunction with extents and/or dimensioning, to mean that a deviation deviates from a predefined value by in particular less than 25%, preferably less than 10%, particularly preferably less than 5% of the predefined value, and very particularly preferably corresponds entirely to the value. It is particularly preferable if the conveying element comprises at least one conveying surface which, viewed in a cross-section of the conveying element, has a maximum transverse extent which is equivalent to, in particular entirely equivalent to or congruent with, a maximum transverse extent of a rigid wall of the conveying space element, which wall at least partly delimits at least the conveying space. The conveying element preferably has, in an unloaded state of the conveying element, a conveying surface which, viewed in a cross-section of the conveying element, has a maximum transverse extent which is equivalent to a maximum transverse extent of a rigid wall of the conveying space element, which wall at least partly delimits at least the conveying space. It may also conceivably be provided that, in a loaded state of the conveying element, the maximum transverse extent of the conveying surface of the conveying element is equivalent to the maximum transverse extent of the rigid wall of the conveying space element, which wall at least partly delimits at least the conveying space. In at least one embodiment of the conveying device, the conveying element preferably comprises at least one conveying surface which, viewed in a cross-section of the conveying element, has a maximum transverse extent which is at least substantially equivalent to a maximum transverse extent of a rigid wall of the first conveying space, which wall delimits at least the first conveying space, at least one further conveying surface which, viewed in a cross-section of the conveying element, has a maximum transverse extent which is at least substantially equivalent to a maximum transverse extent of a rigid wall of the second conveying space, which wall delimits at least the second conveying space, and an additional conveying surface which, viewed in a cross-section of the conveying element, has a maximum transverse extent which is at least substantially equivalent to a maximum transverse extent of a rigid wall of the third conveying space, which wall delimits at least the third conveying space. Here, a "conveying surface" is to be understood in particular to mean a surface of the conveying element which can be utilized in targeted fashion for a conveyance of a conveying medium in and/or through the first conveying space, in and/or through the second conveying space and/or in and/or through the third conveying space and/or which comes into direct contact with a conveying medium for conveying, in particular during a conveyance of a conveying medium. The maximum transverse extent of the conveying surface preferably runs at least substantially transversely, in particular at least substantially perpendicularly, with respect to a conveying direction in and/or through the first conveying space, in and/or through the second conveying space and/or in and/or through the third conveying space. The conveying direction preferably runs in and/or through the first conveying space, in and/or through the second conveying space, and/or in and/or through the third conveying space, from a conveying space inlet to a conveying space outlet. Here, the expression "at least substantially transversely" is to be understood in particular to mean an orientation of a direction and/or of an axis relative to a reference direction and/or a reference axis, wherein the orientation of the direction and/or of the axis is at least different from an at least substantially parallel orientation with respect to the reference direction and/or with respect to the reference axis and is in particular skewed or perpendicular with respect to the reference direction and/or with respect to the reference axis. Here, the expression "at least substantially perpendicular" is intended in particular to define an orientation of a direction relative to a reference direction, wherein the direction and the reference direction, viewed in particular in one plane, enclose an angle of 90° and the angle has a maximum deviation of in particular less than 8°, advantageously less than 5° and particularly advantageously less than 2°. By means of the embodiment according to the invention, it is advantageously possible to permit reduced loading of the conveying element as a result of a deformation. Furthermore, it is advantageously possible to achieve a high level of variability with regard to an activation of the conveying device.

Furthermore, the invention is based on a pump device with at least one conveying device according to the invention and with at least one drive unit for driving the conveying device, wherein the drive unit comprises at least one drive element, which is at least partly enclosed at least by the first conveying space, the second conveying space and the third conveying space. It is proposed that the conveying element is drivable via the drive unit in such a way that a conveyance of a conveying medium according to a traveling-wave principle may be facilitated. The drive unit may be in the form of a mechanical drive unit, a magnetic drive unit, a piezoelectric drive unit, a hydraulic drive unit, a pneumatic drive unit, an electric drive unit, a magnetorheological drive unit, a carbon tubes drive unit, a combination of one of the said types of drive units, or some other drive unit that appears expedient to a person skilled in the art. It is alternatively also conceivable for the pump device to be operable manually, in particular by hand. In an embodiment of the pump device as a manual operable pump device, a fluid can be at least transported into the conveying space as a result of the action of a force exerted on the conveying element by a hand, in particular by at least one finger, of an operator, and/or can be at least transported out of the conveying space as a result of the action of a force exerted on the conveying element by a hand, in particular by at least one finger, of an operator. The manual operable pump device preferably comprises at least one valve unit, which has for example at least one valve, in particular a one-way valve (for example check valve or the like) at a conveying space inlet and at least one valve, in particular a one-way valve (for example check valve or the like) at a conveying space outlet. The drive unit preferably comprises at least one drive element which is provided so as to act on the conveying element, in particular is provided so as to effect an elastic deformation of the conveying element as a result of an action of a drive force on the conveying element. The drive element may be designed in any form that appears expedient to a person skilled in the art, and may for example be designed as a plunger, as a projection, as a helix, as a cam, as a piezo element, as a magnet, as an eccentric or the like. The drive unit preferably comprises at least one electric motor unit which is in particular configured to drive at least the drive element. It is however also conceivable for the drive unit to comprise some other motor unit that appears expedient to a person skilled in the art, for example a combustion engine unit, a hybrid motor unit or the like. The pump device preferably comprises at least one housing unit on which the conveying device can be arranged, in particular can be arranged in exchangeable fashion. By means of the embodiment according to the invention, it is advantageously possible to realize a pump device which permits a high level of variability in terms of a field of use and/or in terms of conveying performance.

It is furthermore proposed that the drive unit be designed as a helical drive unit or as an eccentric drive unit. Here, a "helical drive unit" is to be understood in particular to mean a drive unit which has at least one helical drive element which is provided in particular for subjecting the conveying element to the action of a drive force, in particular to the direct action of a drive force. It is however also conceivable for the drive unit to be of some other design that appears expedient to a person skilled in the art, for example designed as a paternoster drive unit, as a plate disk drive unit or the like. Here, a "paternoster drive unit" is to be understood in particular to mean a drive unit which has at least one force action element which, for an action of a drive force, in particular a direct action of a drive force, on the conveying element, can in particular be driven in rotation, wherein it is provided in particular that the force action element, for an action of a drive force on the conveying element, extends at least substantially parallel to a plane of rotation, in particular in the plane of rotation, in which the force action element can be driven in rotation. Here, a "plate disk drive unit" is to be understood in particular to mean a drive unit which has at least one drive element which, for an action of a drive force, in particular a direct action of a drive force, on the conveying element, is in particular arranged on a plate element which can be driven in rotation, wherein it is provided in particular that the drive element, for an action of a drive force on the conveying element, extends at least substantially parallel to an axis of rotation of the plate element.

The drive unit preferably comprises at least one drive element embodied as a helix or at least one drive element embodied as an eccentric. The drive element is preferably provided for acting directly on the conveying element. It is however also conceivable for at least one further element or further elements to be arranged between the drive element and the conveying element, such as for example a friction-reducing element, a support element or the like. It is advantageous for at least one drive axis of the drive unit to extend at least substantially parallel to the conveying direction of the conveying device, in particular with respect to a conveying direction in the first conveying space. In the case of an embodiment of the drive unit as a helical drive unit or as an eccentric drive unit, it is preferably the case that an axis of rotation of the drive element embodied as a helix or of the drive element embodied as an eccentric, which axis of rotation forms the drive axis of the drive unit, runs at least substantially parallel to the conveying direction in the conveying space. It is preferable for an axis of rotation of a rotor element of the electric motor unit of the drive unit to run at least substantially parallel to the conveying direction in the first conveying space. The axis of rotation of the rotor element of the electric motor unit preferably forms a further drive axis, which runs at least substantially parallel to the conveying direction in the conveying space. By means of the embodiment according to the invention, it is advantageously possible to realize a compact construction of the pump device.

The first conveying space, the second conveying space and the third conveying space, viewed along a direction of rotation of the drive element, are preferably arranged around the drive element. The first conveying space, the second conveying space and the third conveying space, in particular viewed along a direction of rotation of the drive element, are preferably arranged in an equally distributed manner around the drive element. It is furthermore conceivable for the conveying device to comprise further conveying spaces which, together with the first conveying space, the second conveying space and the third conveying space, surround the drive element. It is furthermore conceivable for further conveying spaces of the conveying device and/or the first conveying space, the second conveying space and/or the third conveying space, in particular viewed along the axis of rotation of the drive element, to be arranged on the drive element in axially distributed, in particular axially offset, fashion. Further arrangements of the first conveying space, of the second conveying space, of the third conveying space and/or of further conveying spaces of the conveying device that appear expedient to a person skilled in the art are likewise conceivable. By means of the embodiment according to the invention, it is advantageously possible to achieve expedient use of the drive element.

It is furthermore proposed that the drive unit comprises at least the drive element, which is configured to drive at least the conveying element of the conveying device, which is allocated at least to the first conveying space, at least one further conveying element of the conveying device, which is allocated to the second conveying space, and at least one additional conveying element of the conveying device, which is allocated to the third conveying space. The drive element is preferably provided for permitting a conveyance of a conveying medium in accordance with a traveling-wave principle as a result of an exertion of force by the drive element on the conveying element of the conveying device, which is allocated to the first conveying space, on the further conveying element of the conveying device, which is allocated to the second conveying space, and on the additional conveying element of the conveying device, which is allocated to the third conveying space. The drive element is preferably provided for generating a traveling-wave movement of the conveying element of the conveying device, which is allocated to the first conveying space, of the further conveying element of the conveying device, which is allocated to the second conveying space, and of the additional conveying element of the conveying device, which is allocated to the third conveying space, along a longitudinal axis of the respective conveying element. It is conceivable for the drive element to act directly on the respective conveying element or for an exciter element, for example, to be arranged between the drive element and the respective conveying element, which exciter element is acted on directly by the drive element, wherein the exciter element transmits an action of drive forces to the respective conveying element, which bears at least partly against the exciter element. By means of the embodiment according to the invention, it is advantageously possible to realize a conveyance of a conveying medium through different conveying spaces by means of a single drive element.

Here, it is not the intention for the conveying device according to the invention and/or the pump device according to the invention to be restricted to the usage and embodiment described above. In particular, in order to perform a function described herein, the conveying device according to the invention and/or the pump device according to the invention may have a number of individual elements, components and units and method steps which differs from a number mentioned herein. Furthermore, with regard to the value ranges specified in this disclosure, it is also intended that values lying within the stated limits are disclosed and usable as desired.

DRAWINGS

Further advantages emerge from the following description of the drawings. The drawings illustrate exemplary embodiments of the invention. The drawings, the description and the claims contain numerous features in combination. A person skilled in the art will expediently also consider the features individually and combine these to form further meaningful combinations.

Figure 2:
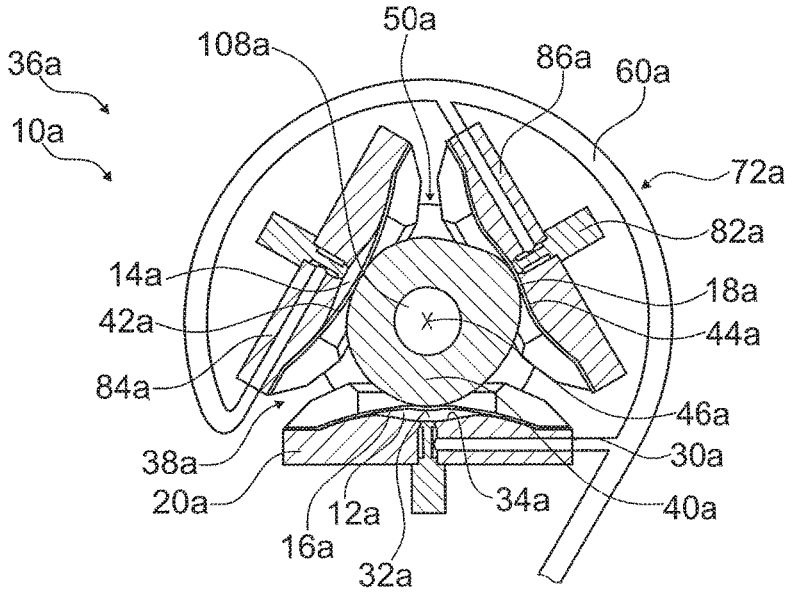
Figure 3:
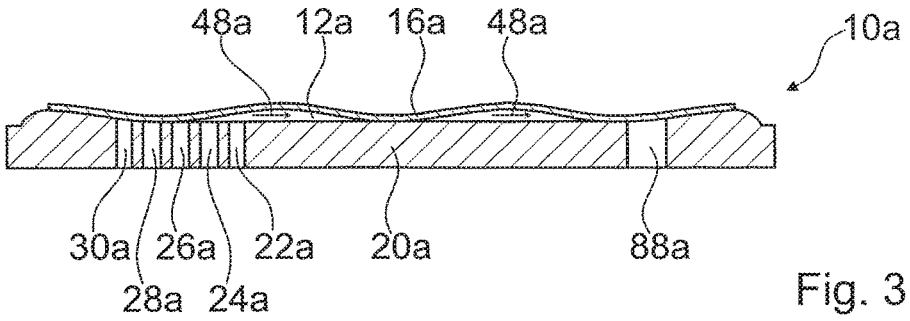
Figure 4:
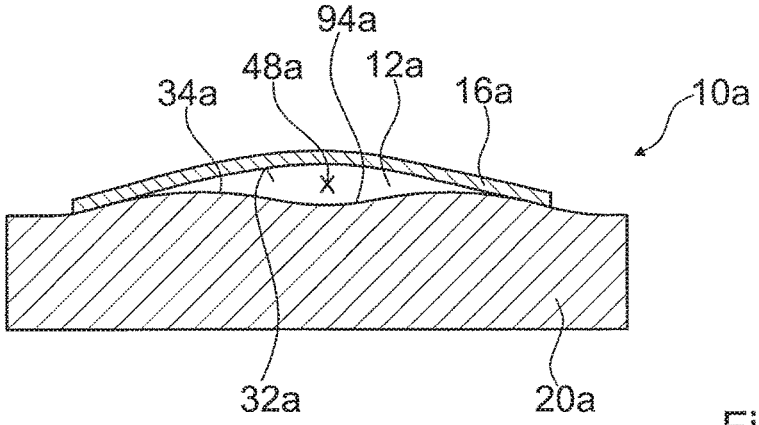
Figure 5:
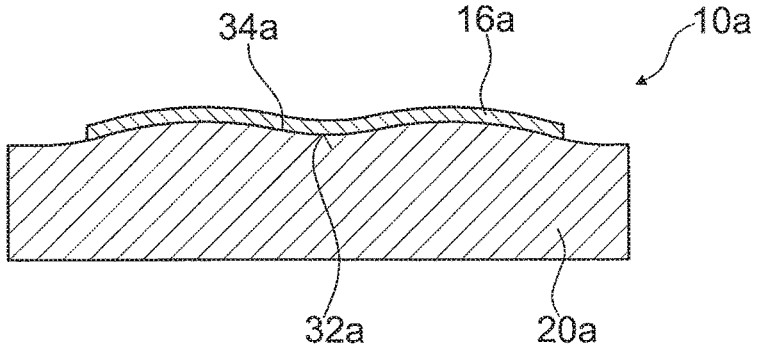
Figure 6:
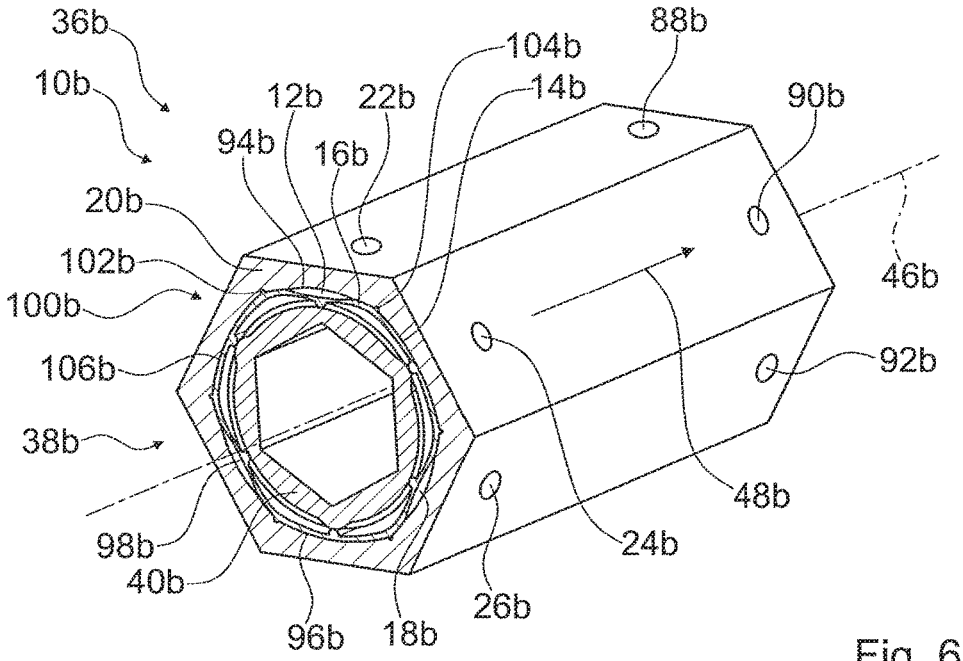
Figure 7:
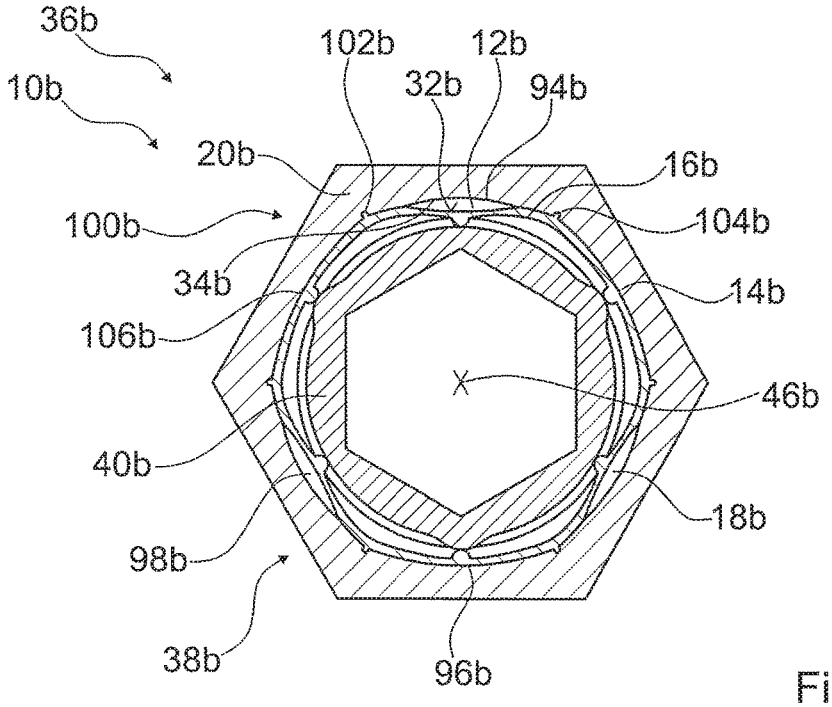
Figure 8:
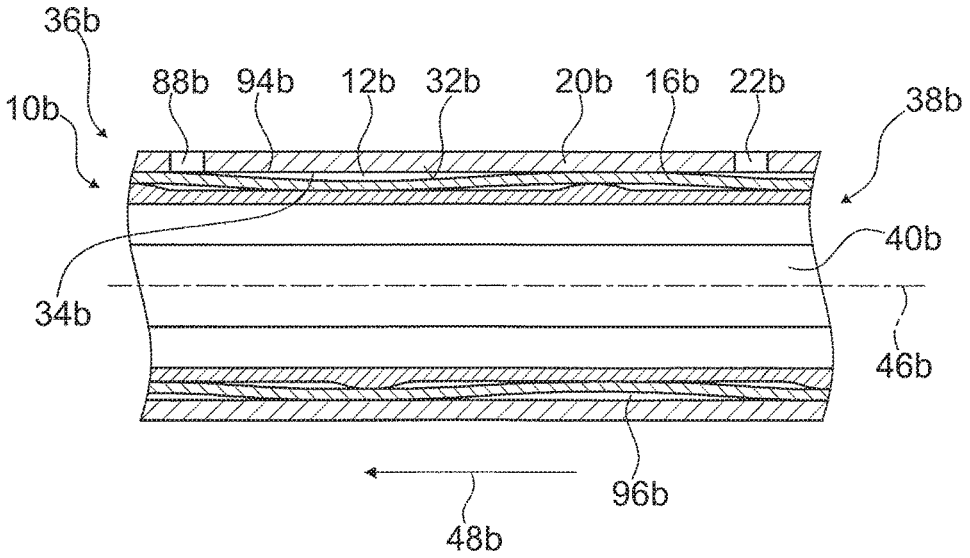
Figure 9:
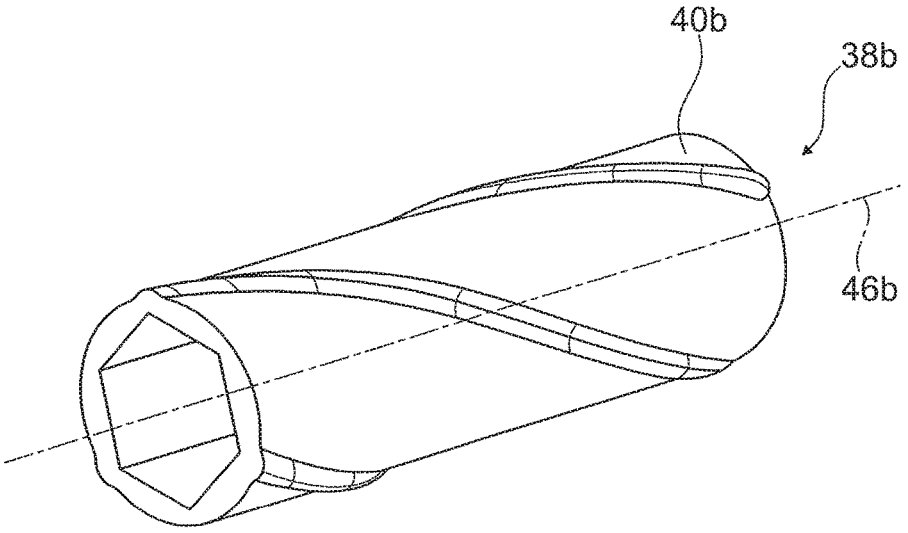

In the drawings:

FIG. 1 shows a pump device according to the invention with at least one conveying device according to the invention in a schematic illustration, FIG. 2 shows a sectional view of the pump device according to the invention in a schematic illustration, FIG. 3 shows a longitudinal section through a conveying space of the conveying device according to the invention, which conveying space is formed by a conveying element and by a conveying space element of the conveying device according to the invention, in a schematic illustration, FIG. 4 shows a cross-section through a conveying space of the conveying device according to the invention in an unloaded state of a conveying element of the conveying device according to the invention in a schematic illustration, FIG. 5 shows a cross-section through a conveying space of the conveying device according to the invention in a loaded state of a conveying element of the conveying device according to the invention in a schematic illustration, FIG. 6 shows an alternative pump device according to the invention with at least one conveying device according to the invention in a schematic illustration, FIG. 7 shows a sectional view of the alternative pump device according to the invention in a schematic illustration, FIG. 8 shows a further sectional view of the alternative pump device according to the invention during a conveying process, in particular from right to left, in a schematic illustration, and FIG. 9 shows a detail view of a drive element of a drive unit of the alternative pump device according to the invention, in a schematic illustration.

DESCRIPTION OF THE EXEMPLARY EMBODIMENTS

FIG. 1 shows a pump device 36*a* with at least one conveying device 10*a* and with at least one drive unit 38*a* for driving the conveying device 10*a*. For control and/or regulation of the drive unit 38*a*, the pump device 36*a* comprises at least one control and/or regulation unit (neither of which is illustrated here), which is of a design already known to a person skilled in the art. The drive unit 38*a* is embodied as a helical drive unit or as an eccentric drive unit. At least one drive axis 46*a* of a drive element 40*a* of the drive unit 38*a* runs at least substantially parallel to a conveying direction 48*a* of the conveying device 10*a*, in particular at least substantially parallel to a conveying direction 48*a* through at least one first conveying space 12*a* of the conveying device 10*a*. The drive element 40*a* is in the form of a drive helix or an eccentric shaft (FIG. 2). The drive element 40*a* is rotatably supported in a housing unit (not illustrated in any more detail here) of the pump device 36*a* in a manner already known to a person skilled in the art. The drive axis 46*a* is configured as an axis of rotation of the drive element 40*a*. The drive element 40*a* is provided for elastically deforming at least one conveying element 16*a* of the conveying device 10*a*, which conveying element is allocated at least to the first conveying space 12*a*, for a conveyance of a conveying medium. The conveying element 16*a* allocated at least to the first conveying space 12*a* is embodied in an elastically deformable fashion. The drive element 40*a* is provided for generating a traveling-wave movement of the conveying element 16*a*, which is allocated at least to the first conveying space 12*a*, along a longitudinal axis of the conveying element 16*a* allocated at least to the first conveying space 12*a*. Here, it is conceivable for the drive element 40*a* to act directly on the conveying element 16*a* allocated at least to the first conveying space 12*a*, or for an exciter element (not illustrated in any more detail here) of the conveying device 10*a* to be arranged between the drive element 40*a* and the conveying element 16*a* allocated at least to the first conveying space 12*a*, which exciter element is acted on directly by the drive element 40*a*, wherein the exciter element transmits an action of drive forces to the conveying element 16*a* allocated at least to the first conveying space 12*a*, which conveying element bears at least partly against the exciter element.

For a movement, in particular a rotation, of the drive element 40*a*, the drive unit 38*a* comprises at least one motor unit 50*a*. The motor unit 50*a* is formed as an electric motor unit. It is however also conceivable for the motor unit 50*a* to be of some other design that appears expedient to a person skilled in the art, for example to be designed as a combustion engine unit, as a hybrid motor unit or the like. The drive element 40*a* may be connected directly, in particular rotationally conjointly, or indirectly, for example by means of a gearing unit of the conveying device 10*a* or by means of at least one toothed gear element of the conveying device 10*a*, to a rotor shaft 108*a* of the motor unit 50*a* (FIG. 2). The rotor shaft 108*a* has an axis of rotation which runs at least substantially parallel, in particular coaxially, with respect to the drive axis 46*a* of the drive element 40*a*.

The drive unit 38*a* comprises at least the drive element 40*a*, which is encompassed at least partly at least by the first conveying space 12*a*, by a second conveying space 14*a* of the conveying device 10*a* and by a third conveying space 18*a* of the conveying device 10*a*. The drive unit 38*a* comprises at least one drive element 40*a*, which is configured to drive at least the conveying element 16*a* of the conveying device 10*a*, which is allocated at least to the first conveying space 12*a*, at least one further conveying element 42*a* of the conveying device 10*a*, which is allocated to the second conveying space 14*a*, and at least one additional conveying element 44*a* of the conveying device 10*a*, which is allocated to the third conveying space 18*a*. The conveying element 16*a* of the conveying device 10*a*, which is allocated to the first conveying space 12*a*, the further conveying element 42*a* of the conveying device 10*a*, which is allocated to the second conveying space 14*a*, and the additional conveying element 44*a* of the conveying device 10*a*, which is allocated to the third conveying space 18*a*, are of at least substantially analogous design. It is thus the intention that a description of one of the conveying elements 16*a*, 42*a*, 44*a* is preferably transferable to all conveying elements 16*a*, 42*a*, 44*a* of the conveying device 10*a*.

The conveying device 10*a* can be arranged, in particular detachably arranged, on the housing unit. Here, the conveying device 10*a* may be embodied as an exchangeable unit, in particular as an interchangeable unit or as a disposable article unit. The conveying device 10*a* is configured at least for conveying a conveying medium. The conveying device 10*a* comprises at least the first conveying space 12*a*, at least the second conveying space 14*a* and at least the elastically deformable conveying element 16*a*, which delimits at least the first conveying space 12*a*. Furthermore, the conveying device 10*a* comprises at least the third conveying space 18*a*. The first conveying space 12*a* has a maximum volume which differs from a maximum volume of the second conveying space 14*a* and/or differs from a maximum volume of the third conveying space 18*a*. The second conveying space 14*a* preferably has a maximum volume which differs from a maximum volume of the third conveying space 18*a*. It is however also conceivable, in an alternative embodiment of the conveying device 10*a*, for the first conveying space 12*a*, the second conveying space 14*a* and/or the third conveying space 18*a* to have at least substantially identical maximum volumes.

At least the first conveying space 12*a* comprises at least two conveying space inlets 22*a*, 24*a*. In the exemplary embodiment of the conveying device 10*a* illustrated in FIG. 1, the first conveying space 12*a* comprises a total of five conveying space inlets 22*a*, 24*a*, 26*a*, 28*a*, 30*a*. The number of conveying space inlets 22*a*, 24*a*, 26*a*, 28*a*, 30*a* of the first conveying space 12*a* may also differ from five. In particular, the number of conveying space inlets 22*a*, 24*a*, 26*a*, 28*a*, 30*a* is dependent on a number of conveying medium storage containers 62*a*, 64*a*, 66*a*, 68*a*, 70*a* of a conveying medium store unit of the conveying device 10*a* that are connectable to the conveying space inlets 22*a*, 24*a*, 26*a*, 28*a*, 30*a*. It is preferable for each conveying space 12*a*, 14*a*, 18*a* of the conveying device 10*a* to comprise at least five conveying space inlets 22*a*, 24*a*, 26*a*, 28*a*, 30*a* which are connectable to the conveying medium storage containers 62*a*, 64*a*, 66*a*, 68*a*, 70*a*. The conveying space inlets 22*a*, 24*a*, 26*a*, 28*a*, 30*a* of the first conveying space 12*a* are connectable to at least one of the conveying medium storage containers 62*a*, 64*a*, 66*a*, 68*a*, 70*a* in each case by means of a conducting element 52*a*, 54*a*, 56*a*, 58*a*, 60*a* of the pump device 36*a*. The conveying medium storage containers 62*a*, 64*a*, 66*a*, 68*a*, 70*a* are configured for storing conveying media. It is conceivable for the same conveying medium to be stored in each of the conveying medium storage containers 62*a*, 64*a*, 66*a*, 68*a*, 70*a*, or for different conveying media to be stored in each of the conveying medium storage containers 62*a*, 64*a*, 66*a*, 68*a*, 70*a*. Conveying media in the form of fluids, such as for example a liquid, a medicine constituent in liquid form, a foodstuff constituent in liquid form or the like, or other conveying media that appear expedient to a person skilled in the art, which are provided in particular for mixing, may be stored in the conveying medium storage containers 62*a*, 64*a*, 66*a*, 68*a*, 70*a*. The conveying medium storage containers 62*a*, 64*a*, 66*a*, 68*a*, 70*a* may be arranged on the housing unit of the pump device 36*a*, in particular in detachable or refillable fashion, or the conveying medium storage containers 62*a*, 64*a*, 66*a*, 68*a*, 70*a* may be positionable separately with respect to the housing unit.

Furthermore, the conveying device 10*a* comprises at least one valve unit 72*a* which is provided for metering an introduction of conveying medium into the conveying spaces 12*a*, 14*a*, 18*a* of the conveying device 10*a*. The valve unit 72*a* is preferably actuable by means of the control and/or regulation unit. The valve unit 72*a* comprises at least one valve element 74*a*, 76*a*, 78*a*, 80*a*, 82*a* per conveying space inlet 22*a*, 24*a*, 26*a*, 28*a*, 30*a*. In the exemplary embodiment illustrated in FIG. 1, the valve unit 72*a* has at least five valve elements 74*a*, 76*a*, 78*a*, 80*a*, 82*a* per conveying space 12*a*, 14*a*, 18*a*. It is however also conceivable for the valve unit 72*a* to have a number of valve elements 74*a*, 76*a*, 78*a*, 80*a*, 82*a* per conveying space 12*a*, 14*a*, 18*a* which differs from five. The valve elements 74*a*, 76*a*, 78*a*, 80*a*, 82*a* are arranged in terms of flow between the respective conducting element 52*a*, 54*a*, 56*a*, 58*a*, 60*a* and the respective conveying space 12*a*, 14*a*, 18*a* (FIG. 2). The valve elements 74*a*, 76*a*, 78*a*, 80*a*, 82*a* are arranged in each case on a conveying space element 20*a*, 84*a*, 86*a*, which delimits the corresponding conveying space 12*a*, 14*a*, 18*a*, of the conveying device 10*a*. The conveying space elements 20*a*, 84*a*, 86*a* of the conveying device 10*a* are embodied in a rigid fashion. Furthermore, the conveying space elements 20*a*, 84*a*, 86*a*, which are embodied in a rigid fashion, of the conveying device 10*a* delimit, together with the respective elastically deformable conveying element 16*a*, 42*a*, 44*a*, the corresponding conveying space 12*a*, 14*a*, 18*a* of the conveying device 10*a*. The conveying device 10*a* comprises at least the elastically deformable conveying element 16*a*, which is allocated to the first conveying space 12*a* and which, at least together with the conveying space element 20*a* which is embodied in a rigid fashion, delimits or forms the first conveying space 12*a*. Furthermore, the conveying device 10*a* comprises the further elastically deformable conveying element 42*a*, which is allocated to the second conveying space 14*a* and which, together with the further conveying space element 84*a* which is embodied in a rigid fashion, delimits or forms the second conveying space 14*a*. Furthermore, the conveying device 10*a* comprises the additional elastically deformable conveying element 44*a*, which is allocated to the third conveying space 18*a* and which, together with the additional conveying space element 86*a* which is embodied in a rigid fashion, delimits or forms the third conveying space 18*a*.

FIG. 3 shows, for one embodiment of the conveying spaces 12*a*, 14*a*, 18*a* of the conveying device 10*a* by way of example, a longitudinal section through the first conveying space 12*a* of the conveying device 10*a*, which is formed at least by the elastically deformable conveying element 16*a* allocated to the first conveying space 12*a* and by the conveying space element 20*a*, which is embodied in a rigid fashion, of the conveying device 10*a*. The conveying element 16*a* allocated to the first conveying space 12*a* is provided for sealing off at least one edge region, which delimits the first conveying space 12*a*, of the conveying space element 20*a*. A conveying medium which can be conveyed in and/or through the first conveying space 12*a* by means of an interaction of the conveying space element 20*a* and of the conveying element 16*a* allocated to the first conveying space 12*a* can be introduced into the first conveying space 12*a* via one of the conveying space inlets 22*a*, 24*a*, 26*a*, 28*a*, 30*a* of the conveying device 10*a*. The conveying space inlets 22*a*, 24*a*, 26*a*, 28*a*, 30*a* are arranged on the conveying space element 20*a*, and in particular are formed in one piece with the conveying space element 20*a*. A conveying medium can be conveyed in and/or through the first conveying space 12*a* by means of a reversible deformation of the conveying element 16*a* allocated to the first conveying space 12*a*. A conveying medium can be conveyed from one of the conveying space inlets 22*a*, 24*a*, 26*a*, 28*a*, 30*a* of the conveying device 10*a* through the first conveying space 12*a* to a conveying space outlet 88*a* of the conveying device 10*a* by means of a reversible deformation of the conveying element 16*a* allocated to the first conveying space 12*a*. The conveying space outlet 88*a* is arranged on the conveying space element 20*a*, and is in particular formed in one piece with the conveying space element 20*a*. The conveying space outlet 88*a* is fluidically connectable to a further unit (not illustrated in any more detail here). The further unit may in this case be a part of the pump device 36*a*, a part of an administration device on which the pump device 36*a* is arranged, a part of a household appliance on which the pump device 36*a* is arranged, or the like. In an embodiment of the pump device 36*a* as part of an administration device, it is in particular conceivable for the further unit to be in the form of an injection unit, in particular in the form of a needle or syringe unit. The further unit may be directly connected to the conveying space outlet 88*a*, or the further unit may be connected in terms of flow to the conveying space outlet 88*a* by means of a separate conveying line, for example a hose. Further connections of the further unit to the conveying space outlet 88*a* in terms of flow that appear expedient to a person skilled in the art are likewise conceivable. The conveying device 10*a* preferably comprises at least one conveying space outlet 88*a*, 90*a* (only two of the three conveying space outlets 88*a*, 90*a* are illustrated in FIG. 1), which is connectable to the further unit, per conveying space 12*a*, 14*a*, 18*a*. In each case one of the conveying space outlets 88*a*, 90*a* is arranged on one of the conveying space elements 20*a*, 84*a*, 86*a*, in particular is formed in one piece with the respective conveying space element 20*a*, 84*a*, 86*a*.

FIG. 4 shows, for one embodiment of the conveying spaces 12*a*, 14*a*, 18*a* of the conveying device 10*a* by way of example, a cross-section through the first conveying space 12*a*, wherein the conveying element 16*a* allocated to the first conveying space 12*a* is illustrated in an unloaded state. In particular, no conveyance of a conveying medium occurs in an unloaded state of the conveying element 16*a* allocated to the first conveying space 12*a*. The conveying element 16*a* allocated to the first conveying space 12*a* can be arranged at least partly in convexly curved fashion on the conveying space element 20*a*. The conveying element 16*a* allocated to the first conveying space 12*a* is, at least in an unloaded state, in particular in a state in which it is not loaded by the action of a drive force that can be generated by means of the drive unit 38*a*, arranged at least partly in convexly curved fashion on the conveying space element 20*a*. The conveying space element 20*a* has at least one concave recess 94*a* for at least partly delimiting and/or for at least partly forming the first conveying space 12*a*. An inner surface, which delimits the recess 94*a*, of the conveying space element 20*a* forms a rigid wall 34*a* of the first conveying space 12*a*. The conveying element 16*a* which is allocated to the first conveying space 12*a* is deformable such that, for a conveyance of a conveying medium, the conveying element 16*a* allocated to the first conveying space 12*a* is movable in the direction of the recess 94*a*, and is in particular movable at least partly into said recess (FIG. 5). The conveying element 16*a* allocated to the first conveying space 12*a* is embodied in a spring-elastic fashion. The conveying element 16*a* which is allocated to the first conveying space 12*a* is connected at least substantially non-detachably to the conveying space element 20*a*, in particular in an edge region, which delimits the recess 94*a*, of the conveying space element 20*a*. The at least substantially non-detachable connection of the conveying element 16*a* which is allocated to the first conveying space 12*a* to the conveying space element 20*a* forms, in particular, a seal between the conveying element 16*a*, which is allocated to the first conveying space 12*a*, and the conveying space element 20*a*. It is however also conceivable for an additional seal element of the conveying device 10*a* to be arranged between the conveying element 16*a*, which is allocated to the first conveying space 12*a*, and the conveying space element 20*a*. The first conveying space 12*a* can preferably be sealed off in fluid-tight fashion preferably as a result of a connection and/or arrangement of the conveying element 16*a*, which is allocated to the first conveying space 12*a*, to and/or on the conveying space element 20*a*.

The conveying element 16*a* which is allocated to the first conveying space 12*a* comprises at least one conveying surface 32*a* which, viewed in a cross-section of the conveying element 16*a* which is allocated to the first conveying space 12*a*, in particular in a cross-section of the first conveying space 12*a*, has a maximum transverse extent which is at least substantially equivalent to a maximum transverse extent of the rigid wall 34*a*, which delimits the conveying space 12*a*, of the first conveying space 12*a*, in particular of the inner surface, which delimits the recess 94*a*, of the conveying space element 20*a* (FIGS. 4 and 5). It is particularly preferable if the conveying element 16*a* comprises at least one conveying surface 32*a* which, viewed in a cross-section of the conveying element 16*a*, has a maximum transverse extent which is equivalent to a maximum transverse extent of a rigid wall 34*a* of the conveying space element 20*a*, which wall at least partly delimits at least the conveying space 12*a*. For a conveyance of a conveying medium in and/or through the first conveying space 12*a*, the conveying surface 32*a* can, as a result of an action of a drive force that can be generated by the drive unit 38*a*, be caused to bear, in particular be caused to bear entirely, against the wall 34*a* of the first conveying space 12*a*, which wall delimits the first conveying space 12*a*, in particular against the inner surface, which delimits the recess 94*a*, of the conveying space element 20*a* (FIG. 5). For a conveyance of a conveying medium in and/or through the first conveying space 12*a*, a traveling-wave movement can be generated by means of an action of a drive force, which can be generated by the drive unit 38*a*, on the conveying element 16*a* which is allocated to the first conveying space 12*a*. A conveyance of a conveying medium is realized at least substantially analogously in the case of all conveying elements 16*a*, 42*a*, 44*a*. The conveying medium can be conveyed out of at least the conveying medium storage containers 62*a*, 64*a*, 66*a*, 68*a*, 70*a*, through the conducting elements 52*a*, 54*a*, 56*a*, 58*a*, 60*a* and into and/or through the conveying spaces 12*a*, 14*a*, 18*a*, in particular owing to a negative pressure, by means of an action of a drive force, which can be generated by the drive unit 38*a*, on the conveying elements 16*a*, 42*a*, 44*a*. Furthermore, the conveying medium can be conveyed out of the conveying spaces 12*a*, 14*a*, 18*a* through the conveying space outlets 88*a*, 90*a* to a further unit by means of an action of a drive force, which can be generated by the drive unit 38*a*, on the conveying elements 16*a*, 42*a*, 44*a*.

FIGS. 6 to 9 show a further exemplary embodiment of the invention. The following descriptions and the drawings are restricted substantially to the differences between the exemplary embodiments, wherein, with regard to components with identical designation, in particular with regard to components with the same reference numerals, reference may basically also be made to the drawings and/or to the description of the other exemplary embodiments, in particular of FIGS. 1 to 5. To distinguish between the exemplary embodiments, the alphabetic character a has been added as a suffix to the reference numerals of the exemplary embodiment in FIGS. 1 to 5. In the exemplary embodiments of FIGS. 6 to 9, the alphabetic character a has been replaced by the alphabetic character b.

FIG. 6 shows an alternative pump device 36*b* with at least one conveying device 10*b* and with at least one drive unit 38*b* for driving the conveying device 10*b*. The drive unit 38*b* at least partially illustrated in FIGS. 6 to 9 is of an at least substantially analogous design to the drive unit 38*a* illustrated in FIGS. 1 to 5. The drive unit 38*b* comprises at least one drive element 40*b*, in particular a drive element 40*b* embodied as a drive helix or as an eccentric shaft (FIG. 9), which drive element is at least partially encompassed by at least one first conveying space 12*b* of the conveying device 10*b*, by a second conveying space 14*b* of the conveying device 10*b* and by a third conveying space 18*b* of the conveying device 10*b*. In an embodiment as a drive helix, the drive element 40*b* may have one or more helix elements which has/have for example a circular-segment-like cross-section, an undulating cross-section, in particular an undulating cross-section with at least two undulation peaks and one undulation trough, wherein the undulation peaks may have identical or different maximum heights. The one or more helix elements may be formed from a resiliently elastic material or may be formed from the same material as a main body of the drive element 40*b*. Further refinements of the drive element 40*b* that appear expedient to a person skilled in the art are likewise conceivable.

The drive element 40*b* is provided for driving at least one conveying element 16*b* of the conveying device 10*b*, which conveying element is allocated at least to the first conveying space 12*b*. The conveying element 16*b* of the conveying device 10*b* is allocated to the first conveying space 12*b*, to the second conveying space 14*b* and to the third conveying space 18*b*. Here, it is conceivable for the drive element 40*b* to act directly on the conveying element 16*b*, or for an exciter element of the conveying device 10*b* to be arranged between the drive element 40*b* and the conveying element 16*b*, which exciter element is acted on directly by the drive element 40*b*, wherein the exciter element transmits an action of drive forces to the conveying element 16*b* allocated at least to the first conveying space 12*b*, which conveying element bears at least partly against the exciter element. The exciter element may be of any design that appears expedient to a person skilled in the art. In the embodiment of the conveying device 10*b* illustrated in FIGS. 6 and 7, the exciter element is illustrated by way of example as a rib, in particular as a rib formed in one piece with the conveying element 16*b*, wherein, in particular, at least one exciter element embodied as a rib is arranged on the conveying element 16*b* in a region, which is allocated to each conveying space 12*b*, 14*b*, 18*b*, of the conveying element 16*b*.

The conveying device 10*b* comprises at least the first conveying space 12*b*, at least the second conveying space 14*b* and at least the elastically deformable conveying element 16*b*, which delimits at least the first conveying space 12*b*. Furthermore, the conveying device 10*b* comprises at least the third conveying space 18*b*. The conveying element 16*b* delimits the first conveying space 12*b*, the second conveying space 14*b* and/or the third conveying space 18*b*. The conveying device 10*b* furthermore comprises at least one conveying space element 20*b*, which is embodied in a rigid fashion and delimits, together with the conveying element 16*b*, at least the first conveying space 12*b* and the second conveying space 14*b*. The conveying space element 20*b* delimits, together with the conveying element 16*b*, at least the first conveying space 12*b*, the second conveying space 14*b* and the third conveying space 18*b*. Altogether, in the embodiment of the conveying device 10*b* illustrated in FIGS. 6 to 8, the conveying element 16*b* and the conveying space element 20*b* together delimit at least five conveying spaces 12*b*, 14*b*, 18*b*, 96*b*, 98*b*, 106*b*. It is however also conceivable for the conveying element 16*b* and the conveying space element 20*b* to delimit or form a number of conveying spaces 12*b*, 14*b*, 18*b*, 96*b*, 98*b*, 106*b* of the conveying device 10*b* which differs from six. The conveying space element 20*b* encompasses the conveying element 16*b* at least partly, in particular entirely, as viewed along a direction of rotation of the drive element 40*b*.

The conveying element 16*b* can be arranged on the conveying space element 20*b*, in particular can be fixed to an inner surface of the conveying space element 20*b*, by means of a fastening unit 100*b* of the conveying device 10*b*. The fastening unit 100*b* comprises at least one fastening element 102*b* for an arrangement of the conveying element 16*b* on the conveying space element 20*b*. Furthermore, the fastening unit 100*b* comprises at least one further fastening element 104*b* for an arrangement of the conveying element 16*b* on the conveying space element 20*b*. In particular as viewed in a plane running at least substantially perpendicular to a drive axis 46*b* of the drive unit 38*b*, the fastening element 102*b* and the further fastening element 104*b* are arranged at edge regions, which delimit at least one of the conveying spaces 12*b*, 14*b*, 18*b*, 96*b*, 98*b*, of the conveying element 16*b*. Thus, in each case one of the conveying spaces

12*b*, 14*b*, 18*b*, 96*b*, 98*b*, 106*b* is arranged between two fastening elements 102*b*, 104*b* as viewed along the direction of rotation of the drive element 40*b*. The fastening elements 102*b*, 104*b* are provided for a form-fitting and/or force-fitting fastening of the conveying element 16*b* to the conveying space element 20*b*. In particular, the fastening elements 102*b*, 104*b* are formed as fastening webs which are formed in one piece with the conveying element 16*b* and which engage in each case into a fastening recess, which is arranged on the conveying space element 20*b*, of the fastening unit 100*b* (FIGS. 6 and 7). It is however also conceivable for the fastening elements 102*b*, 104*b* to be of some other design that appears expedient to a person skilled in the art. Altogether, the fastening unit 100*b* has six fastening elements 102*b*, 104*b*, wherein, in particular, in each case one of the conveying spaces 12*b*, 14*b*, 18*b*, 96*b*, 98*b*, 106*b* is arranged between two of the fastening elements 102*b*, 104*b* as viewed along the direction of rotation of the drive element 40*b*.

The conveying element 16*b* has an annulus-shaped cross section, in particular as viewed in the plane running at least substantially perpendicular to the drive axis 46*b* of the drive unit 38*b*. The conveying spaces 12*b*, 14*b*, 18*b* are arranged between the conveying element 16*b* and the conveying space element 20*b* as viewed along a direction running at least substantially perpendicular to the drive axis 46*b* of the drive unit 38*b*. The conveying space element 20*b* has a polygonal design, in particular as viewed in the plane running at least substantially perpendicular to the drive axis 46*b* of the drive unit 38*b*. The conveying space element 20*b* is embodied in a hollow fashion. The drive element 40*b* and the conveying element 16*b* are arranged in an interior space of the conveying space element 20*b*. The conveying space element 20*b* can be arranged rotationally fixedly in a housing unit (not illustrated in any more detail here) of the pump device 36*b* in a manner already known to a person skilled in the art. The drive element 40*b* can be supported rotatably in the housing unit.

The conveying device 10*b* comprises at least one conveying space inlet 22*b*, 24*b*, 26*b* per conveying space 12*b*, 14*b*, 18*b*, 96*b*, 98*b*, 106*b* (only three conveying space inlets 22*b*, 24*b*, 26*b* are illustrated in FIG. 6). Furthermore, the conveying device 10*b* comprises at least one conveying space outlet 88*b*, 90*b*, 92*b* per conveying space 12*b*, 14*b*, 18*b*, 96*b*, 98*b*, 106*b* (only three conveying space outlets 88*b*, 90*b*, 92*b* are illustrated in FIG. 6). For a conveyance of a conveying medium in and/or through the conveying spaces 12*b*, 14*b*, 18*b*, 96*b*, 98*b*, 106*b*, a traveling-wave movement can be generated by means of an action of a drive force, which can be generated by the drive unit 38*b*, on the conveying element 16*b* (FIG. 8). With regard to further features and functions of the conveying device 10*b* and of the pump device 36*b*, reference may be made to the conveying device 10*b* and the pump device 36*a* described in the description of FIGS. 1 to 5.

The invention claimed is:

1. A conveying device for conveying a conveying medium, comprising:

a first conveying space and a first elastically deformable conveying element, which delimits the first conveying space, a second conveying space and a second elastically deformable conveying element, which delimits the second conveying space, a third conveying space and a third elastically deformable conveying element, which delimits the third conveying space, a first rigid conveying space element, which delimits the first conveying space together with the first elastically deformable conveying element, a second rigid conveying space element, which delimits the second conveying space together with the second elastically deformable conveying element, a third rigid conveying space element, which delimits the third conveying space together with the third elastically deformable conveying element, wherein the first elastically deformable conveying element, the second elastically deformable conveying element and the third elastically deformable conveying element are spring-elastic, wherein the first conveying space, the second conveying space and the third conveying space are spatially separate from each other, wherein the first conveying space, the second conveying space and the third conveying space are fluidly separate from each other to independently convey the conveying medium, wherein, the first conveying space element, the second conveying space element and the third conveying space element are formed spatially separate from each other, wherein the first elastically deformable conveying element is in a non-conveyance state arranged on the first rigid conveying space element in a convexly curved shape, wherein, following a deformation, the first elastically deformable conveying element automatically seeks to re-assume its original convexly curved shape, wherein the second elastically deformable conveying element is in a non-conveyance state arranged on the second rigid conveying space element in a convexly curved shape, wherein, following a deformation, the second elastically deformable conveying element automatically seeks to re-assume its original convexly curved shape, wherein the third elastically deformable conveying element is in a non-conveyance state arranged on the third rigid conveying space element in a convexly curved shape, wherein, following a deformation, the third elastically deformable conveying element automatically seeks to re-assume its original convexly curved shape, wherein the first rigid conveying space element comprises, for at least partly forming the first conveying space, a concave recess, wherein an inner surface of the first rigid conveying space element, which delimits the concave recess, forms a wall of the first conveying space, wherein the first elastically deformable conveying element is, starting from the original convexly curved shape, which is oriented in a direction facing away from the first rigid conveying space element, elastically deformed towards the first rigid conveying space element and at least partly movable into the concave recess of the first rigid conveying space element, wherein the second rigid conveying space element comprises, for at least partly forming the second conveying space, a concave recess, wherein an inner surface of the second rigid conveying space element, which delimits the concave recess, forms a wall of the second conveying space, wherein the second elastically deformable conveying element is, starting from the original convexly curved shape, which is oriented in a direction facing away from the second rigid conveying space element, elastically deformed towards the second rigid conveying space element and at least partly movable into the concave recess of the second rigid conveying space element, wherein the third rigid conveying space element comprises, for at least partly forming the third conveying space, a concave recess, wherein an inner surface of the third rigid conveying space element, which delimits the concave recess, forms a wall of the third conveying space, and wherein the third elastically deformable conveying element is, starting from the original convexly curved shape, which is oriented in a direction facing away from the third rigid conveying space element, elastically deformed towards the third rigid conveying space element and at least partly movable into the concave recess of the third rigid conveying space element.

2. A pump device with at least one conveying device according to claim 1, and with a drive unit for driving the conveying device, wherein the drive unit comprises a drive element, which is at least partly enclosed at least by the first conveying space, the second conveying space and the third conveying space, and wherein the first elastically deformable conveying element, the second elastically deformable conveying element and the third elastically deformable conveying element are drivable via the drive unit in such a way that a conveyance of a conveying medium according to a traveling-wave principle is facilitated.

3. The pump device according to claim 2, wherein the drive element is configured to drive the first elastically deformable conveying element of the conveying device, which is allocated to the first conveying space, the second elastically deformable conveying element of the conveying device, which is allocated to the second conveying space, and the third elastically deformable conveying element of the conveying device, which is allocated to the third conveying space.

4. The conveying device according to claim 1, wherein a circumference of the first conveying space is defined by a portion of the first rigid conveying space element and a portion of the first elastically deformable conveying element, wherein a circumference of the second conveying space is defined by a portion of the second rigid conveying space element and a portion of the second elastically deformable conveying element, and wherein a circumference of the third conveying space is defined by a portion of the third rigid conveying space element and a portion of the third elastically deformable conveying element.

5. The conveying device according to claim 1, wherein the first conveying element comprises, in a load-free state of the first conveying element, a conveying surface, which, viewed in a cross section of the first conveying element, has a maximum transverse extent, which is formed by a length of an outline of the first conveying element, which delimits the first conveying space, facing the first conveying space element and is equivalent to a maximum transverse extent of a rigid wall of the first conveying space element, whereas the maximum transverse extend of the rigid wall, viewed in a cross section of the first conveying space element, is formed by a length of an outline of the concave recess, which delimits the first conveying space.

6. The conveying device according to claim 1, wherein the second conveying element comprises, in a load-free state of the second conveying element, a conveying surface, which, viewed in a cross section of the second conveying element, has a maximum transverse extent, which is formed by a length of an outline of the second conveying element, which delimits the second conveying space, facing the second conveying space element and is equivalent to a maximum transverse extent of a rigid wall of the second conveying space element, whereas the maximum transverse extend extent of the rigid wall, viewed in a cross section of the second conveying space element, is formed by a length of an outline of the concave recess, which delimits the second conveying space.

7. The conveying device according to claim 1, wherein the third conveying element comprises, in a load-free state of the third conveying element, a conveying surface, which, viewed in a cross section of the third conveying element, has a maximum transverse extent, which is formed by a length of an outline of the third conveying element, which delimits the third conveying space, facing the third conveying space element and is equivalent to a maximum transverse extent of a rigid wall of the third conveying space element, whereas the maximum transverse extend of the rigid wall, viewed in a cross section of the third conveying space element, is formed by a length of an outline of the concave recess, which delimits the third conveying space.

8. The conveying device according to claim 1, wherein the first conveying element and the first conveying space element, the second conveying element and the second conveying space element, and the third conveying element and the third conveying space element each form an exchangeable unit, which is removable as a whole without being destroyed or without disassembly of individual parts, from an element or from a further unit of the conveying device.

9. The conveying device according to claim 1, wherein the concave recess in the first conveying space element, the second conveying element and/or the third conveying space element is embodied by the space between two convex bulges, which are formed in parallel on the first conveying space element, the second conveying element and/or the third conveying space element along the conveyance direction.

* * * * *